US007383646B2

(12) United States Patent
Hall

(10) Patent No.: US 7,383,646 B2
(45) Date of Patent: Jun. 10, 2008

(54) ATHLETIC SHOE COVER

(76) Inventor: Rodney R. Hall, 7651 Curtis, Detroit, MI (US) 48221

( * ) Notice: Subject to any disclaimer, the term of this patent is extended or adjusted under 35 U.S.C. 154(b) by 674 days.

(21) Appl. No.: 10/266,164

(22) Filed: Oct. 7, 2002

(65) Prior Publication Data

US 2003/0088996 A1 May 15, 2003

Related U.S. Application Data

(63) Continuation of application No. 09/730,799, filed on Dec. 5, 2000, now abandoned.

(51) Int. Cl.
*A43B 3/18* (2006.01)

(52) U.S. Cl. ..... 36/7.1 R; 36/7.2; 36/7.3; 36/72 R

(58) Field of Classification Search ..... 36/7.3, 36/7.1 R, 7.2, 7.4, 1.5, 96, 133, 72 R
See application file for complete search history.

(56) References Cited

U.S. PATENT DOCUMENTS 2,032,793 A * 3/1936 Clark et al.
2,171,654 A * 9/1939 Hinchliff et al.
2,190,579 A * 2/1940 Wash
D128,422 S 7/1941 McGillicuddy
2,260,138 A * 10/1941 Feinberg
2,447,284 A * 8/1948 Sidnam et al.
2,479,006 A * 8/1949 Garth
2,970,390 A * 2/1961 Briugh et al.
3,875,687 A * 4/1975 Henderson ..... 36/7.1 R
4,010,558 A * 3/1977 Slusher ..... 36/7.3
4,281,466 A 8/1981 Malone
4,411,077 A 10/1983 Slavitt
4,604,816 A 8/1986 Davison
4,713,895 A 12/1987 Valliéres
4,825,563 A * 5/1989 Strongwater ..... 36/72 R
5,074,059 A 12/1991 Melcher
D357,345 S 4/1995 Cheatwood et al.
5,822,887 A 10/1998 Turner
5,845,416 A * 12/1998 Hands ..... 36/7.2
5,887,359 A * 3/1999 Falguere ..... 36/2 R
D413,711 S 9/1999 Hicks, Jr.
5,950,333 A * 9/1999 Tsen ..... 36/7.1 R

* cited by examiner

*Primary Examiner*—Marie Patterson
(74) *Attorney, Agent, or Firm*—Brooks Kushman P.C.

(57) ABSTRACT

A cover for an athletic shoe includes an elastic fabric upper member sized to snugly conformally fit over an athletic shoe covering at least the mid-foot region of a shoe upper portion and extending above and encircling the wearer's ankle. An elastic lower member extends under at least a portion of the shoe sole spanning the inboard and outboard side panels of the upper member without covering the gripping surfaces of the shoe sole. A zipper is provided in the fabric upper member to form an openable seam enabling the wearer to remove the athletic shoe and attach the cover on the wearer's foot without removing the cover from the shoe.

20 Claims, 5 Drawing Sheets

ATHLETIC SHOE COVER

This is a continuation of application Ser. No. 09/730,799 filed on Dec. 5, 2000 now abandoned.

TECHNICAL FIELD

The present invention relates to shoe covers and, more particularly, to shoe covers for athletic shoes.

BACKGROUND ART

A variety of shoe covers have been manufactured over the years. These shoe covers generally fall into two categories: overshoes and gaiters. An example of an overshoe is rubber boots of the elastic bootie or buckle variety. An Overshoe completely covers the sole portion of a shoe and a substantial portion of the shoe upper. The overshoe is provided with a lower sole surface which, when in use, provides the gripping surface between the wearer and the ground. Gaiters, on the other hand, typically cover the ankles and a portion of the mid-sole of wearer's shoes extending upwards along the wearer's calf. Gaiters frequently have a strap which extend under the sole of the shoe forward of the heel in order to keep the gaiter from creeping up the wearer's leg. Decorative gaiters are frequently used as part of a decorative marching band uniform. Functional gaiters are used in outdoor winter sports such as cross-country skiing or snowshoeing where the gaiter is used to cover the lace portion of the shoe and a substantial portion of the wearer's sock and lower leg.

Overshoes are typically formed of natural or synthetic rubber and, in the case of rubber booties, elastically conform to the wearer's shoe. Gaiters, on the other hand, can be formed of relatively non-elastic materials such as leather, molded plastic, heavy canvas, or woven synthetic fabric and loosely conform to the wearer's lower leg.

DISCLOSURE OF INVENTION

Accordingly, a shoe cover of the present invention is provided for installation upon an athletic shoe having an upper portion and a sole. The shoe cover is both aesthetically pleasing and functional. The shoe cover is made up of an elastic fabric upper member which is sized to snugly conformally fit over the athletic shoe upper portion. The elastic fabric panel covers at least the top and inboard and outboard side portions of the mid-foot region of the shoe upper portion and extends above and encircles a wearer's ankle. An elastic lower member extends under at least a portion of the shoe spanning between inboard and outboard side panels of the fabric upper member. A zipper is provided in the fabric upper member to form an openable seam which extends from an ankle opening along a sufficient length of the fabric upper member to enable the wearer's shoe to be installed and removed when the zipper seam is open. Closing of the zipper seam causes the elastic fabric upper member to snugly conformally fit over the athletic shoe, covering the top portion of the shoe from the mid-foot region to and above the wearer's ankle.

Various embodiments of the present invention are disclosed. Several embodiments are designed for use with an athletic shoe having removable screw-in cleats providing a gripping surface on the shoe sole. The screw-in cleat embodiments in the invention have a lower elastic member provided by extensions of the elastic fabric upper member side panels which extend below the shoe sole and are joined on a common seam. At least a plurality of the screw-in cleats are installed in the shoe sole through the lower elastic member and serve to attach the shoe cover to the athletic shoe.

An alternative embodiment of the invention is specifically adapted for use with athletic shoes having a molded-in gripping surface wherein the elastic lower member is provided by at least one strap extending between inboard and outboard side panels of the fabric upper member and spanning the shoe sole in a region in which gripping surfaces are not provided for engaging an athletic playing surface.

Various zipper orientations are likewise disclosed. The zipper may extend along the longitudinal axis of the shoe from the ankle opening forward or from the ankle opening rearward along the Achilles tendon seam. Alternatively, the zipper may be asymmetrically oriented relative to the shoe longitudinal axis in order to provide a smooth upper shoe panel uninterrupted by a seam.

The shoe cover of the present invention is ideally suited for providing a unified team look and providing unified team logos where a number of athletes on a team have shoes of different styles and manufacture.

BEST MODE FOR CARRYING OUT THE INVENTION

Figure 1:
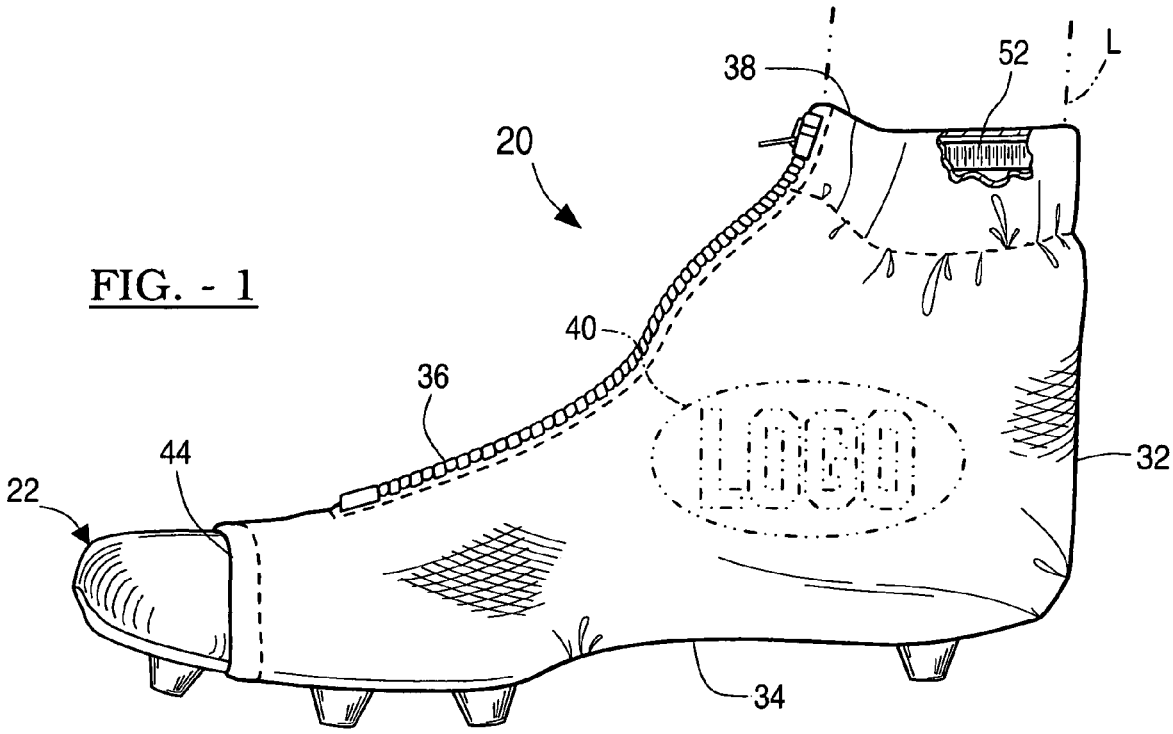
FIG. 1 is a side elevational view of a first shoe cover embodiment installed on a shoe.
Figure 2:
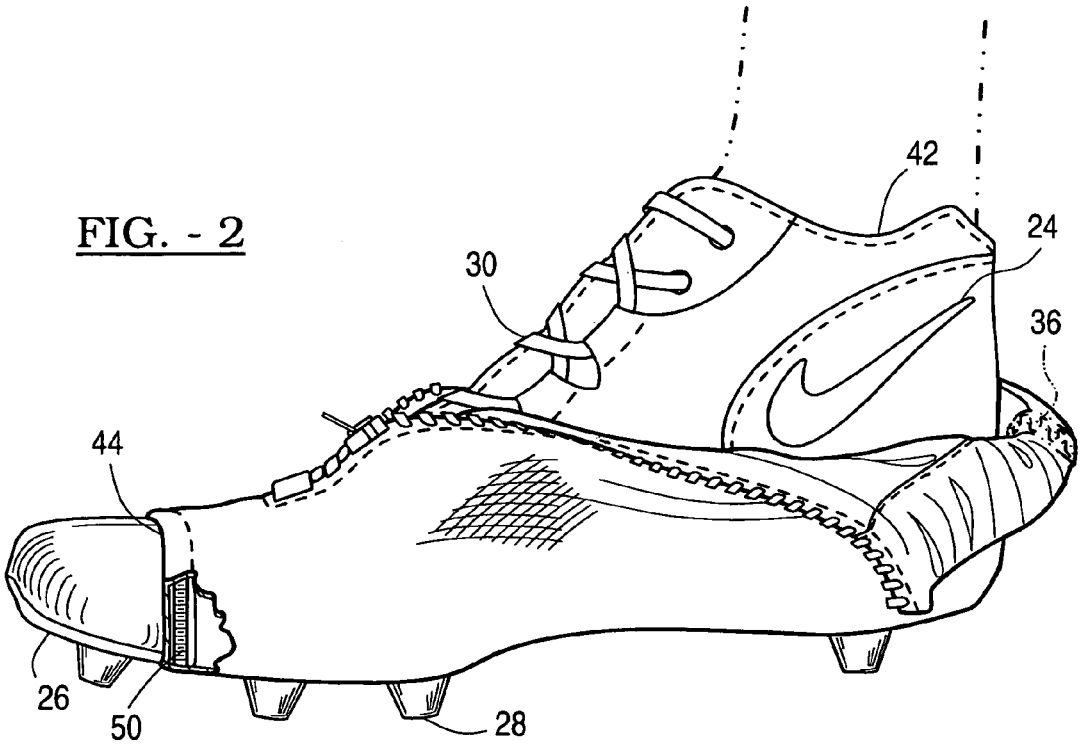
FIG. 2 is a view of the shoe cover of FIG. 1 partially removed from the shoe to enable the wearer to put on or remove the shoe from the wearer's foot.
Figure 3:
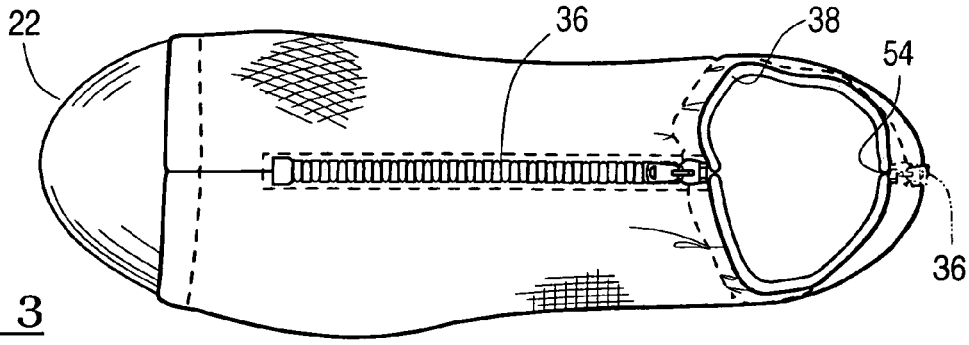
FIG. 3 is a top plan view of the shoe cover of FIG. 1.

The first embodiment of the invention is illustrated by shoe cover 20, shown in FIGS. 1-5. FIG. 1 illustrates shoe cover 20 installed on a typical high-top football shoe 22, which is made up of a shoe upper portion 24, a shoe sole 26 where the shoe sole is provided with a plurality of screw-in cleats 28. Screw-in cleats 28 form gripping surfaces to securely engage an athletic playing surface which, in the case of a football field, would be a natural grass or an artificial turf field. Upper portion 24 of athletic shoe 22 is further provided with a shoelace closure 30 in the upper mid-foot region of the shoe 22 of a conventional design, as best seen in FIG. 2.

In use, shoe cover 20 is sized to snugly and conformally fit over shoe upper portion 22 to provide a neat, clean aesthetic appearance, as illustrated in FIG. 1. Shoe cover 20 is made up of elastic fabric upper member 32, which snugly fits and conformally follows the contours of at least the mid-foot region of the shoe and extends above and encircles the wearer's ankle and the lower leg L. Cover 20 is further provided with an elastic lower member 34 which extends under at least a portion of the shoe sole 26 spanning between the inboard and outboard side panels of the fabric upper member. Elastic lower member 34 does not inhibit gripping surfaces, namely cleats 28, from engaging the athletic playing surface which the shoe is used upon. The shoe further includes a zipper 36 which is sewn in the fabric upper member 32 and forms an openable seam which extends from ankle opening 38 formed in the elastic fabric upper member 32 along a sufficient length of the elastic fabric upper member so that when the zipper is unzipped, the wearer can access the shoelace closure 30 of shoe 22 as shown in FIG. 2.

When shoe cover 20 is installed on an athletic shoe 22, the shoe cover provides a neat, aesthetic appearance. The elastic fabric cover member 32 of the shoe cover is ideally suited for displaying a team logo 40, which may be a sewn-on patch or a stencil-painted symbol identifying a team, sponsor or product manufacturer. The athletic shoe cover of the present invention enables an athletic team where the team members have shoes of a variety of different styles and manufacture to provide a uniform team aesthetic look by covering up shoe brand logos 42 that are mounted on individual player shoes. Shoe cover 20 additionally protects and covers the shoe closure, i.e., the shoe laces 30 or the like, minimizing the likelihood that the shoe laces will become untied during a game situation.

In the first embodiment of the invention illustrated, shoe cover 20 is provided with an annular toe opening 44 through which the toe of shoe 22 projects. Shoe cover 20 is manufactured from two elastic fabric cut-outs which are substantially identical and correspond to the pattern shown in FIG. 5. A pair of cutouts 46 are sewn together along a longitudinal axis 48. Annular toe opening 44 and ankle opening 38 are appropriately hemmed. Zipper 36 is sewn into the top instep portion of the fabric upper member as illustrated. Preferably, an elastic band 50 is sewn into the fabric cutout at annular toe opening 44 to cause the shoe cover to securely grip the shoe 22 in the toe region as illustrated. Similarly, a C-shaped elastic band 52 is sewn into the fabric upper member 32 at the ankle opening 38. When the openable zipper seam is closed, elastic band 52 snugly conforms ankle opening 38 to the wearer's leg L.

Figure 4:
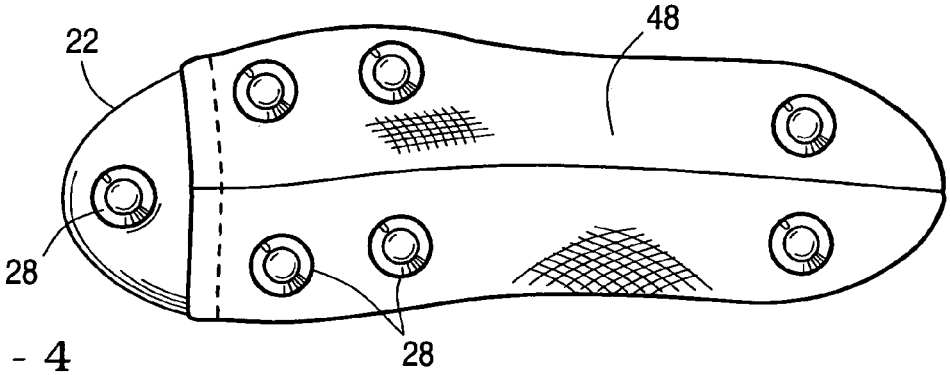
FIG. 4 is a bottom plan view of the shoe cover of FIG. 1.
Figure 5:
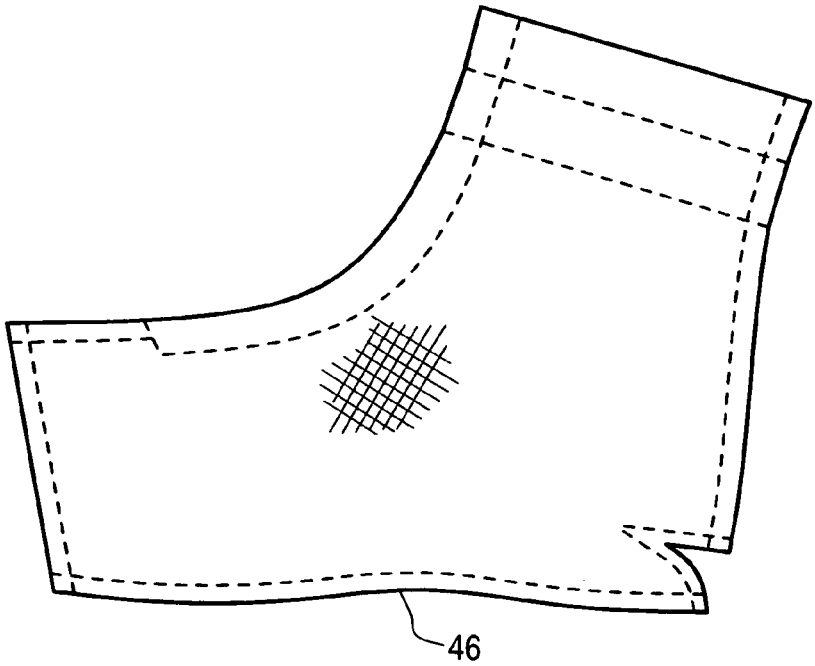
FIG. 5 illustrates the inboard and outboard patterns used to make the shoe cover of FIG. 1.

In the first embodiment illustrated, the elastic lower member 34 is integrally formed from fabric cutouts 46 to form the fabric upper member 32 as well as lower member 34. Shoe cover 20 is installed on athletic shoe 22 with screw-in cleats removed. With the shoe cover properly positioned and zipper 36 properly closed, as illustrated in FIG. 1, small holes are formed in the elastic lower member 34 using an awl or the like so that screw-in cleats 28 may be reinstalled as shown in FIG. 4. Screw-in cleats 28 serve to retain shoe cover 20 on shoe 22 when zipper 36 is opened, as illustrated in FIG. 2. Once installed on the shoe, shoe cover 22 stays with the shoe during normal use as the shoe is removed and once again put back on. The shoe cover may be simply removed by unscrewing screw-in cleats 28 to enable the shoe cover to be washed or replaced.

Shoe cover 20 of the present embodiment is made from cutouts 46 formed of a nylon-Lycra®, 87%-13% blend having a 7.6 ounce fabric weight. Lycra® is a trademark of DuPont Corporation. Heavy elastic fabric of this type is very commonly used in the manufacture of bicycle pants. The fabric has a bidirectional stretch characteristic, is highly durable, and is breathable. Other porous elastic fabrics having similar properties are likewise suitable for fabricating the present invention provided that the material has sufficient elasticity and durability for the particular athletic shoe application. For example, a football shoe which is used in a very hostile environment where other players' cleats are constantly stepping on one's shoes would require a heavier and more durable fabric than the shoe cover adapted for use in a marching band.

It should be further noted that while shoe cover 20 is shown with zipper 36 extending longitudinally forward of anide opening 38, zipper 36 could alternatively be located rearward of the anide opening, extending along Achilles tendon seam 54. By locating zipper 36 along Achilles tendon seam 54, as shown in phantom outline in FIG. 3, the top mid-sole portion of elastic fabric upper member 32 can be provided with additional graphics or logos.

Figure 6:
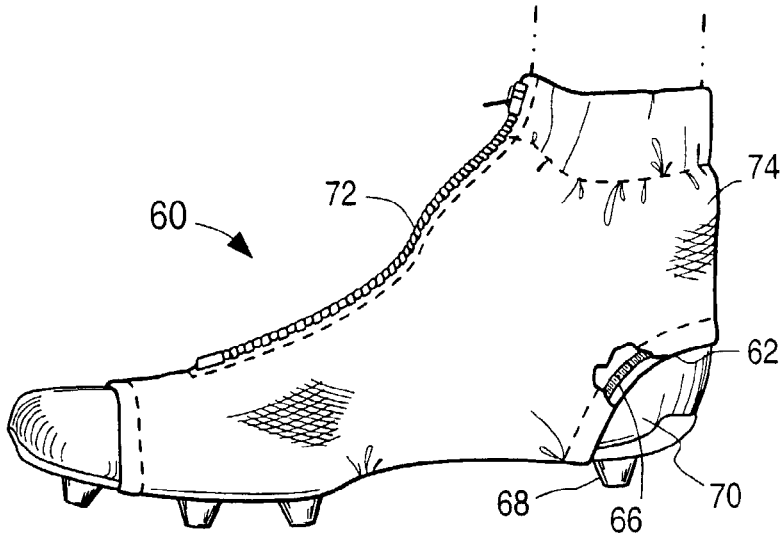
FIG. 6 is a side elevational view of a second shoe cover embodiment.
Figure 7:
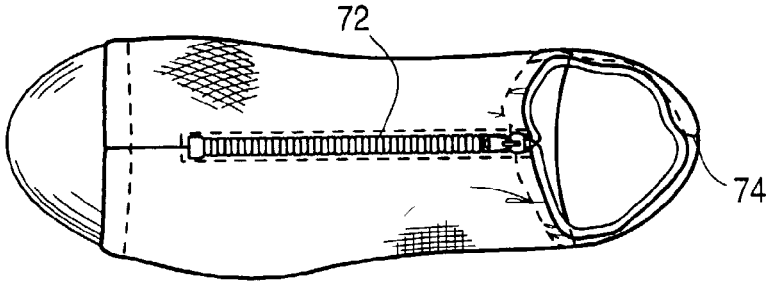
FIG. 7 is a top plan view of the shoe cover of FIG. 6.
Figure 8:
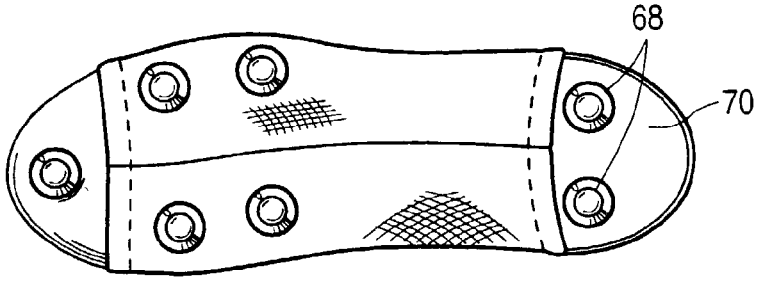
FIG. 8 is a bottom plan view of the shoe cover of FIG. 6.
Figure 9:
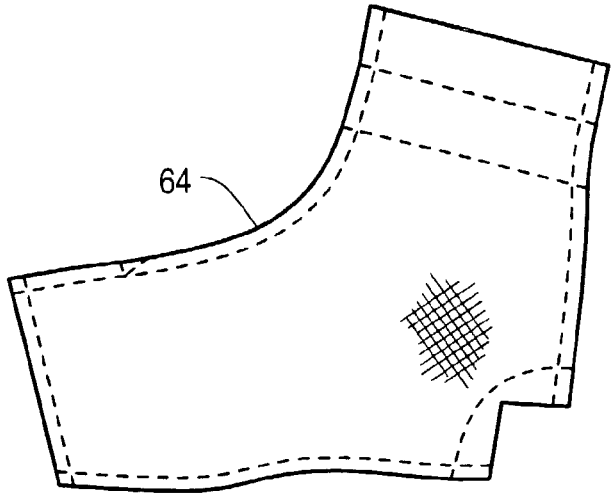
FIG. 9 illustrates a pattern used to make the shoe cover of FIG. 6.
Figure 10:
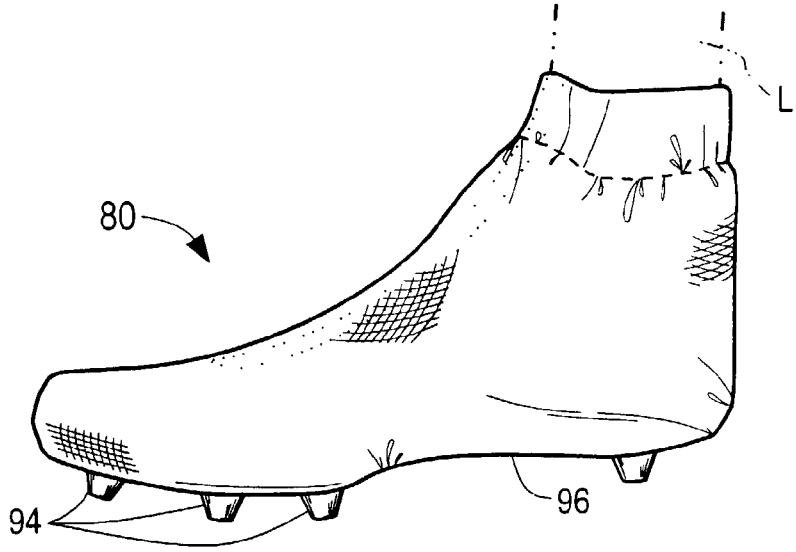
FIG. 10 is a side elevational view of a third shoe cover embodiment.

Shoe cover 60 shown in FIGS. 6-9 illustrates a second embodiment of the present invention. Shoe cover 60 is very similar to shoe cover 20, shown and referenced in FIGS. 1-5. Shoe cover 60 is provided with an annular heel opening 62. Fabric cutout 64 is accordingly modified to provide for the annular heel opening. Annular heel opening 62 has an elastic band 66 hemmed therein in order to securely conform the shoe cover to the athletic shoe. Preferably, annular heel opening 62 is sized sufficiently so that a typical football shoe having screw-in cleats, the heel cleats 68, and shoe heel portion 70 will protrude through annular heel opening 62 as illustrated in FIGS. 6 and 8. Shoe cover 60, like shoe cover 20, is provided with a zipper 72 which may be located on the shoe mid-sole instep as illustrated, or alternatively at the Achilles tendon seam 74.

Figure 13:
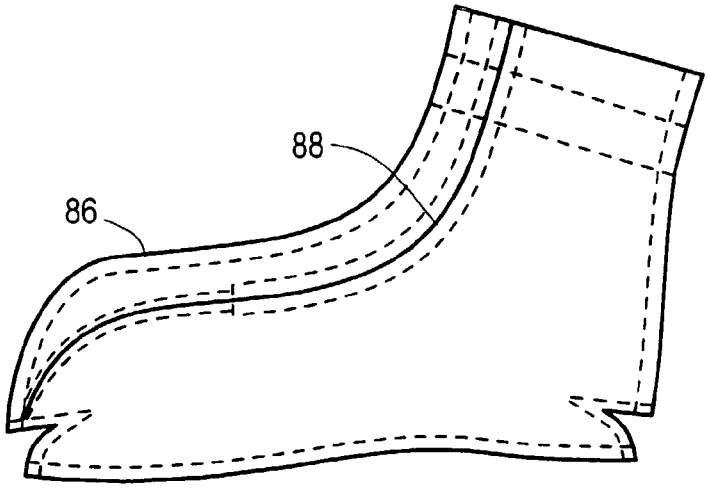
FIG. 13 illustrates two patterns used to make the shoe cover of FIG. 10.
Figure 14:
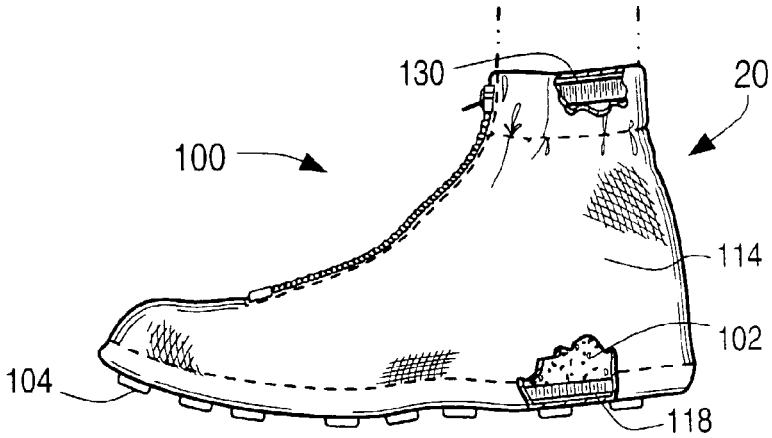
FIG. 14 is a partial, cut-away side elevational view of a fourth embodiment of the shoe cover.
Figure 15:
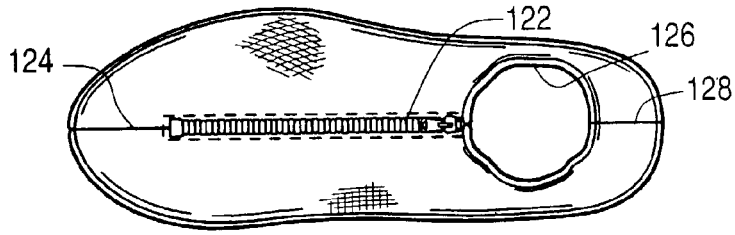
FIG. 15 is a top plan view of the shoe cover of FIG. 14.
Figure 16:
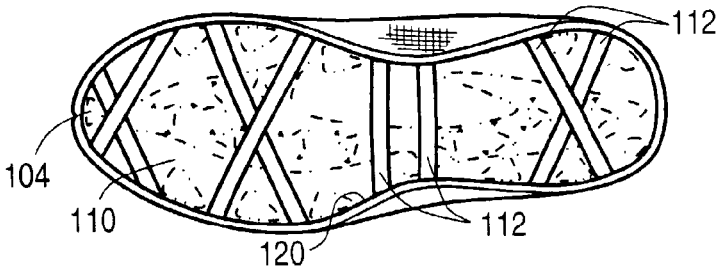
FIG. 16 is a bottom plan view of the shoe cover of FIG. 14.

Shoe cover 80 illustrated in FIGS. 10-13 represents a third embodiment of the present invention. Shoe cover 80 completely encircles the shoe, covering both the toe heel and mid-foot regions and extends above the wearer's ankle to encircle the wearer's leg L. In addition, shoe cover 80 is provided with a zipper 82 which forms a zipper seam which is located significantly to one side of longitudinal axis 84. The seam is preferably to the inside of the wearer's foot, thereby necessitating that the shoe covers be made in symmetrical right and left pairs. The offset zipper is achieved by forming the shoe cover of cutouts 86 and 88 having a different shaped upper edge. As illustrated in FIG. 13, the remainder of the cutout periphery forming the sole seam and Achilles seam are preferably unchanged. By offsetting the zipper seam 82 to the side of longitudinal axis 84, the zipper can be moved to the inside of the shoe providing a smooth, seamless upper surface for installing a logo 90. Alternatively, zipper 82 can be located along the Achilles tendon seam 92, in which case the asymmetrical forward seam would be stitched closed, further rendering a clean, smooth appearance of the forefoot maximized logo space. As described previously with reference to shoe covers 20 and 60, screw-in cleats 94 extend through elastic lower member 96 of the shoe cover and are attached to the shoe sole.

A fourth shoe cover embodiment 100 is illustrated in FIGS. 14-17. Shoe cover 100 is designed to be used with an athletic shoe 102 provided with molded-in gripping surfaces such as cleats 104, illustrated in FIGS. 14 and 16, or forefoot and heel pads 106 and 108, illustrated in an alternative shoe sole configuration shown in FIG. 17. Cleats 104 or forefoot and heel pads 106 and 108 are integrally formed as part of sole 110 or 110' illustrated in FIGS. 16 and 17. The primary difference between shoe cover 100 and shoe cover 80 is the design of straps 112 and 112', which form the elastic fore member of the shoe cover. Where shoe covers 20, 60 and 80 all have an elastic lower member formed as extensions of the inboard and outboard side panels of the elastic fabric upper member, shoe cover 100 is provided with straps 112 and 112' which are separate and distinct components and preferably integrally not part of a flexible fabric upper member 114. The lower edge of elastic fabric member cutout 116 shown in FIG. 18 is hemmed and an elastic band 118, illustrated in the fragment cutout in FIG. 14, securely encircles the outer periphery of sole 110 and forms a lower annular opening 120 which conformally fits about the shoe sole 110. A plurality of straps 112, preferably three or more, are provided when shoe cover 100 is intended to be used with shoes with molded and rubber cleats such as certain types of football and soccer shoes where the straps can fit between the cleats and do not interfere with the engagement of the cleats and the athletic playing surface upon which it is used.

Figure 17:
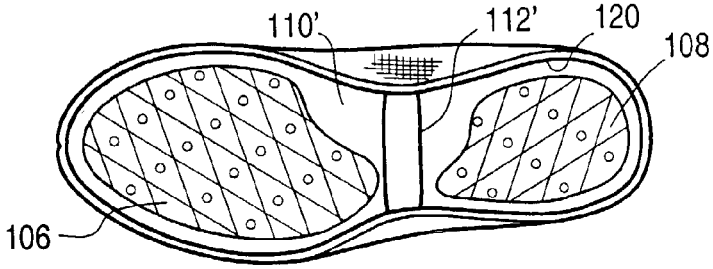
FIG. 17 is an alternative bottom plan view of the shoe cover of FIG. 14.
Figure 18:
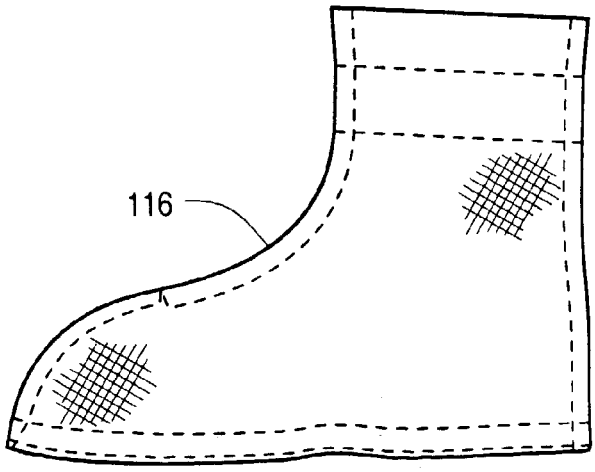
FIG. 18 is a drawing of a pattern for making a panel used in the structure of FIG. 1.

In the case of a shoe, as shown in FIG. 17, having a relatively continuous forefoot pad 106 and rear heel pad 108, the only place which a strap 112' could be located is in the arch region of the shoe sole between a forefoot and heel pads 106 and 108. Examples of this type of shoes are certain basketball shoes and cross-training shoes which are provided with a raised, arched portion. Straps 112 and 112' are preferably formed of an elastomeric material in order to accommodate a variety of shoe shapes and sizes with a single shoe cover.

Figure 11:
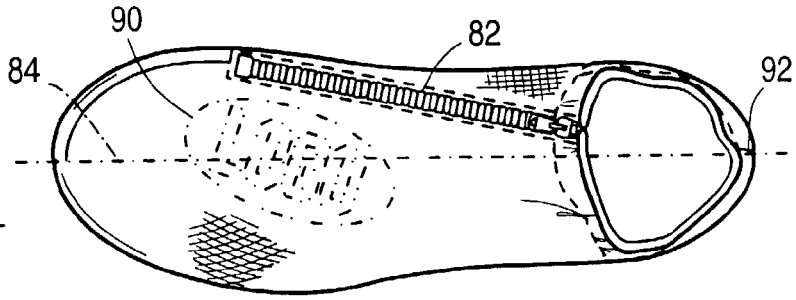
FIG. 11 is a top plan view of the shoe cover of FIG. 10.
Figure 12:
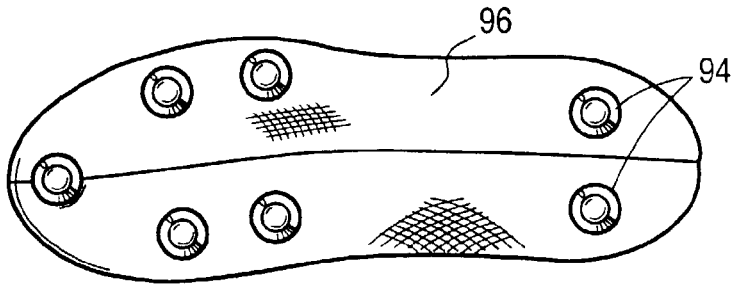
FIG. 12 is a bottom plan view of the shoe cover of FIG. 10.

In the fourth embodiment of shoe cover 100 illustrated in FIGS. 14-17, zipper 122 is provided in the flexible upper member 114 and is oriented along longitudinal seam 124 and extends forward from ankle opening 126. However, as previously described, the zipper 122 may alternatively extend rearwardly along Achilles tendon seam 128. In the embodiment illustrated, the shoe cover 100 is made from two substantially identically sized cutout panels 116. However, an asymmetrical panel design resulting in an offset seam, as shown in FIG. 11, alternatively can be used as previously described with reference to the shoe cover 80 embodiment.

The fabric upper member 114 has a C-shaped elastic band 130 sewn into a hem in the ankle opening 126 so that the fabric upper member snugly conforms to the wearer's leg. Ankle opening 126 is split by the seam on the zipper 122, enabling the shoe and shoe cover to be easily removed by the wearer. Ideally, the lower annular opening 120 and elastic band 128 will so securely wrap about the outer periphery of sole 110 that the shoe cover remains in place when the zipper seam is opened and the shoe is being removed or installed from the wearer's foot.

While the best mode for carrying out the invention has been described in detail, those familiar with the art to which this invention relates will recognize various alternative designs and embodiments for practicing the invention as defined by the following claims.

What is claimed is:

1. A cover for an athletic shoe having an upper portion enclosing a wearer's foot and ankle, and a sole provided with gripping surfaces for engaging an athletic playing surface, the cover comprising:

an elastic fabric upper member sized to snugly conformally fit over an athletic shoe having elastic panels covering at least a top and an inboard and outboard side of a mid-foot region of the shoe upper portion, and extending above and encircling the wearer's ankle;

an elastic lower member extending under at least a portion of the shoe sole and spanning between the inboard and outboard side panels of the fabric upper member without inhibiting the gripping surface of the sole from engaging the athletic playing surface; and a zipper cooperating with the fabric upper member to form an openable seam which extends from an ankle opening in the fabric upper member along a sufficient length of the fabric upper member to enable the wearer of the shoe to remove the shoe from the wearer's foot when the zipper seam is open without totally removing the cover from the shoe, and closing the zipper seam causes the elastic fabric upper member to snugly conformally fit over the shoe upper member.

2. The cover of claim 1 for use with an athletic shoe provided with screw-in cleats which are removably attached to the sole of the shoe to provide a gripping surface, wherein when the cover is installed the elastic lower member extends over at least across a mid-sole area of the sole with at least a plurality of the screw-in cleats removed, whereupon the removed screw-in cleats are re-installed so that screw portions thereof project through a plurality of holes formed in the elastic lower member in order to attach the cover to the shoe sole.

3. The cover of claim 2 wherein the elastic lower member is integrally formed as extensions of the inboard and outboard side panels of the elastic fabric upper member.

4. The cover of claim 3 wherein the elastic fabric upper member does not extend over a toe region of the athletic shoe and the elastic fiber upper member and the elastic lower member collectively form an annular toe opening through which a toe region of the athletic shoe projects.

5. The cover of claim 4 wherein the annular toe opening is further provided with an elastic band insert to snugly encircle the athletic shoe adjacent the toe region.

6. The cover of claim 3 wherein the elastic fabric upper member does not extend over a heel region of the athletic shoe and the elastic fabric upper member and the elastic lower member collectively form an annular heel opening through which a heel region of the athletic shoe projects.

7. The cover of claim 6 wherein the annular heel opening is further provided with an elastic band insert to snugly encircle the athletic shoe adjacent the heel region.

8. The cover of claim 3 wherein the ankle opening formed in the elastic fabric upper member is further provided with a C-shaped elastic band sewn into the elastic fabric upper member which is closed to encircle the wearer's ankle by the zipper seam.

9. The cover of claim 3 wherein the elastic fabric upper member is formed from two generally symmetrical panels which are joined together along a longitudinal seam and wherein the zipper seam is oriented along a portion of the length of the longitudinal seam.

10. The cover of claim 9 wherein the zipper seam extends from the ankle opening forward along the longitudinal seam toward the toe region of the athletic shoe.

11. The cover of claim 9 wherein the zipper seam extends along the longitudinal seam from the ankle opening toward the heel region of the athletic shoe.

12. The cover of claim 3 wherein the elastic fabric upper member is formed of a pair of non-symmetrical inboard and outboard panels which are joined along a seam which forward of the ankle opening is oriented off of the longitudinal axis and forms along a portion of its length the openable zipper seam.

13. The cover of claim 3 wherein the elastic flexible upper member extends over the toe region and heel region of the athletic shoe to substantially close the entire athletic shoe upper member.

14. The cover of claim 1 for use with an athletic shoe provided with molded-in gripping surfaces in the shoe sole, wherein the elastic lower member further comprises at least one strap extending across the shoe sole in a region which is not provided with gripping surfaces.

15. The cover of claim 14 wherein the elastic fabric upper member encloses the entire upper portion of the athletic shoe.

16. The cover of claim 15 wherein the elastic fabric upper member forms a lower annular opening which elastically extends about an outer peripheral edge of the shoe sole.

17. The cover of claim 16 wherein the lower annular opening in the elastic fabric upper member is further provided with an elastic band insert attached to the elastic fabric upper member to securely encircle the periphery of the sole of the athletic shoe.

18. The cover of claim 16 wherein the elastic lower member further comprises at least three straps which extend across the shoe sole in regions which are not provided with gripping surfaces.

19. The cover of claim 15 wherein the ankle opening formed in the elastic fabric upper member is further provided with a C-shaped elastic band sewn into the elastic fabric upper member which is closed to encircle the wearer's ankle by the zipper seam.

20. The cover of claim 15 wherein the elastic fabric upper member is formed of two substantially identically sized panels joined along a longitudinal seam wherein a portion of the longitudinal seam is coextensive with the openable zipper seam.

* * * * *